US009829266B1

(12) United States Patent
Shaver et al.

(10) Patent No.: US 9,829,266 B1
(45) Date of Patent: Nov. 28, 2017

(54) LIGHTWEIGHT PLATFORM RECOIL APPARATUS AND METHOD

(71) Applicant: Vadum Inc., Raleigh, NC (US)

(72) Inventors: Jesse Hart Shaver, Cary, NC (US); Michael Joseph Trapani, Raleigh, NC (US)

(73) Assignee: Vadum, Inc., Raleigh, NC (US)

( * ) Notice: Subject to any disclaimer, the term of this patent is extended or adjusted under 35 U.S.C. 154(b) by 36 days.

(21) Appl. No.: 14/999,739

(22) Filed: Jun. 21, 2016

Related U.S. Application Data

(63) Continuation-in-part of application No. 13/694,768, filed on Jan. 3, 2013, now Pat. No. 9,404,718.

(51) Int. Cl.

| | |
|---|---|
| ***F41A 25/20*** | (2006.01) |
| ***F41A 25/16*** | (2006.01) |
| ***F41A 25/06*** | (2006.01) |
| ***F41A 25/02*** | (2006.01) |
| ***F41A 25/22*** | (2006.01) |
| ***F41A 25/26*** | (2006.01) |

(52) U.S. Cl.
CPC ..... *F41A 25/16* (2013.01); *F41A 25/02* (2013.01); *F41A 25/06* (2013.01); *F41A 25/22* (2013.01); *F41A 25/26* (2013.01)

(58) Field of Classification Search
CPC ..... F41A 25/00; F41A 25/02; F41A 25/06; F41A 23/00; F41A 23/02
USPC ..... 89/42.01, 43.01, 44.01
See application file for complete search history.

(56) References Cited

U.S. PATENT DOCUMENTS

| | | | | |
|---|---|---|---|---|
| 3,677,135 | A * | 7/1972 | Haug, Jr. | F41A 25/00 89/135 |
| 8,468,928 | B2 * | 6/2013 | Wynes | F41A 25/02 89/43.01 |
| 8,863,365 | B2 * | 10/2014 | Silieti | B23P 19/025 29/254 |
| 2014/0325885 | A1 * | 11/2014 | Lim | F41A 25/02 42/1.06 |
| 2016/0298922 | A1 * | 10/2016 | Duncan | F41A 23/02 |

* cited by examiner

*Primary Examiner* — J. Woodrow Eldred
(74) *Attorney, Agent, or Firm* — Emily M. Walker

(57) ABSTRACT

An apparatus and method of recoil mitigation for a gun mounted on a lightweight platform is disclosed.

6 Claims, 9 Drawing Sheets

LIGHTWEIGHT PLATFORM RECOIL APPARATUS AND METHOD

CROSS REFERENCE TO RELATED APPLICATIONS

This application is a continuation-in-part of pending patent application Ser. No. 13/694,768 filed Jan. 3, 2013, which is incorporated herein by reference.

ACKNOWLEDGEMENT OF SUPPORT AND DISCLAIMER

This material is based upon work supported by the United States Army under Contract No. W15QKN-12-C-0005. Any opinions, findings and conclusions or recommendations expressed in this material are those of the author and do not necessarily reflect the views of the Army.

BACKGROUND

The present invention generally relates to the field of gun recoil, and more particularly to an apparatus and method of recoil mitigation for a gun mounted on a light platform.

Momentum is the product of mass and velocity of a moving object. Through the principle of conservation of momentum, a projectile fired using a gun imparts to the gun an equal momentum in the opposite direction of the momentum of the fired projectile. This imparted momentum is known as recoil. High mass projectiles fired at high velocities can create significant undesirable and damaging recoil, particularly to guns attached to lightweight platforms such as small ground robotic vehicles or aerial drones. However, operating environments may necessitate the use of such projectiles and lightweight platforms in order to protect human safety. One example requiring recoil mitigation is an explosive ordnance disrupter mounted on a small, lightweight robotic platform.

Several prior art designs for mitigation of gun recoil are known, employing springs, brakes, and pneumatics. However, most prior art designs are gun-specific and not readily modified to account for recoil changes due to variations in gun mass, gun form, projectile mass, and projectile firing velocity. In these cases, the recoil system must be largely redesigned to account for changes in parameters such as gun mass or projectile load. Further, prior art designs do not efficiently utilize the mass of the gun and recoil apparatus components in a variable-recoil mitigation strategy tailored for attachment to light platforms.

SUMMARY

The present invention provides a method and apparatus that allows mass-efficient recoil mitigation for a projectile-firing device mounted on a lightweight platform. Embodiments of the invention set forth in the accompanying drawings and description integrate design features to address recoil of a projectile-firing device shooting a variety of projectiles in common explosive device disruption operational conditions, including operation of the projectile-firing device mounted to a lightweight robotic platform. Other features and advantages of the invention will be apparent from the description, drawings and claims.

In the first exemplary embodiment, a recoil apparatus comprising a recoil chassis, dissipator, transfer mechanism, ramp, and motion guide is disclosed.

The recoil chassis serves as a sliding mount for a projectile-firing device. The dissipator and the transfer mechanism also mount on the recoil chassis. The dissipator converts kinetic energy to waste heat in a well-defined manner over a physical stroke through hydraulic, pneumatic, dry friction, magnetorheological, or electromagnetic mechanisms. The transfer mechanism matches the physical stroke of the sliding recoil chassis to the physical stroke of the dissipator through a mechanical linkage. The recoil chassis, dissipator, transfer mechanism and a mounted projectile-firing device form the recoiling mass of the apparatus.

The motion guide mounts to a platform such as a robot or an aerial drone and is designed to constrain the motion of the recoil chassis to a linear translation. The ramp mounts rigidly to the motion guide and, like the motion guide, does not contribute to the recoiling mass of the apparatus. The ramp provides a shaped planar, convex, concave or multi-segmented surface tailored to linearize the force of the recoil stroke imparted by the recoiling mass of the apparatus as translated to the dissipator through transfer mechanism.

The apparatus design maximizes the recoiling mass by mounting the dissipator, transfer mechanism and a projectile-firing device on the sliding recoil chassis, which decreases the initial velocity of the recoil for a given momentum, and therefore reduces the kinetic energy which must be dissipated. The apparatus allows recoil adjustment to account for variations in gun mass, gun form, projectile mass, projectile firing velocity, and available stroke length through modifications to the ramp profile and through dissipator selection. The maximum kinetic energy dissipated may be modified by detaching and replacing the dissipator without impacting the gun or platform design. The apparatus design also facilitates use of light platform mounts, by maximizing the recoiling mass over a controlled stroke to mitigate recoil reaching the mount rather than increasing the mass of the mount to withstand the full energy of recoil. Light platforms, such as man-transportable robotic mounts, typically weigh less than 500 lbs (227 kg) and are often more susceptible to recoil damage than heavier mounts.

In further exemplary embodiments of the apparatus, a multi-shot disrupter and robotic platform are specified. During firing, significant recoil momentum is imparted to the disrupter. The disclosed embodiment facilitates use of high-velocity slug loads and high-mass water loads typical in robot-mounted disrupter operations by mitigating the recoil with low transferred forces to the platform, rather than transferring high forces to the robotic platform.

The method of the present invention relates to dissipation of recoil energy caused by firing a multi-shot disrupter using the recoil apparatus. The method of mitigating recoil comprises the steps of providing a recoil apparatus of the present invention with a robotic platform, a motion guide, a ramp, a recoil chassis, a transfer mechanism, a dissipator, and a multi-shot disrupter; and firing the multi-shot disrupter, whereby the kinetic energy of recoil of the multi-shot disrupter is dissipated over the linear translation stroke of the recoil chassis. The method provides a mass-efficient technique to mitigate recoil energy from a multi-shot disrupter mounted on a robotic platform.

The embodiments of the present invention provide and facilitate the mitigation of recoil for a gun mounted on a platform, such as the recoil of a multi-shot disrupter firing loads and projectiles from a lightweight robotic platform.

DETAILED DESCRIPTION

A method and apparatus for recoil mitigation for a projectile-firing device is provided. During the firing process, recoil acts upon the projectile-firing device as momentum imparted in the opposite direction of projectile travel. Momentum of recoil is equal to the product of the recoiling mass and the velocity of the recoiling mass. Recoil is mitigated prior to reaching a platform mount using the disclosed invention through mass-efficient placement of apparatus components and dissipation features. The mass-efficient placement of apparatus components maximizes the recoiling portion of the apparatus mass while allowing the platform mount to remain stationary, improving ability of the dissipator to convert the kinetic energy of the recoiling mass into waste heat in a controlled linear manner superior to prior art.

Recoil mitigation is particularly important for projectile-firing devices attached to lightweight platforms, such as robotic mounts, which may be flipped or damaged by the force of unmitigated recoil. Embodiments of the invention set forth in the accompanying drawings and description integrate design features to address recoil mitigation in common explosive device disruption operational conditions, such as high-velocity slug loads and high-mass water loads fired from a disrupter on a lightweight delicate robotic mount of limited carrying capacity.

Figure 1:
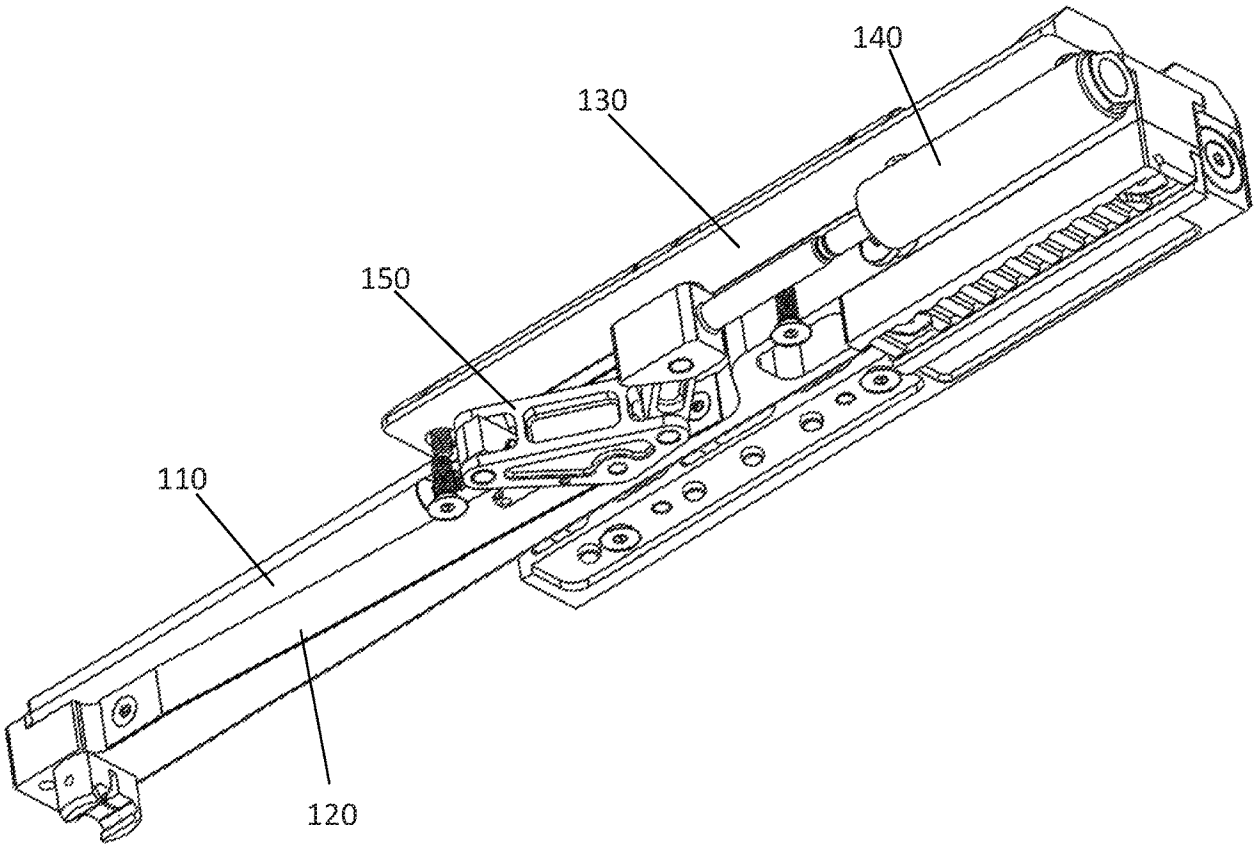
FIG. 1 is a perspective representation of the recoil apparatus.

The recoil apparatus of FIG. 1 includes a dissipator, a transfer mechanism, a recoil chassis, a ramp, and a motion guide. The recoiling mass of the apparatus includes the mass of the dissipator, the transfer mechanism, and the recoil chassis in addition to the mass of a mounted projectile-firing device. In the preferred embodiment, the motion guide 110 is adapted to constrain the recoiling mass of the apparatus along a substantially linear path. The ramp 120 mounts rigidly to the motion guide and provides a shaped surface tailored to adapt the force of the recoil stroke imparted by the recoiling mass of the apparatus to a desired profile, such as a linear profile. The recoil chassis 130 serves as a sliding mount for recoiling mass of the apparatus. The dissipator 140 and the transfer mechanism 150 also mount on the recoil chassis. The dissipator 140 converts kinetic energy to waste heat in a well-defined manner over a physical stroke through hydraulic, pneumatic, dry friction, magnetorheological, or electromagnetic mechanisms. The transfer mechanism 150 matches the physical stroke of the sliding recoil chassis 130 to the physical stroke of the dissipator.

Figure 2:
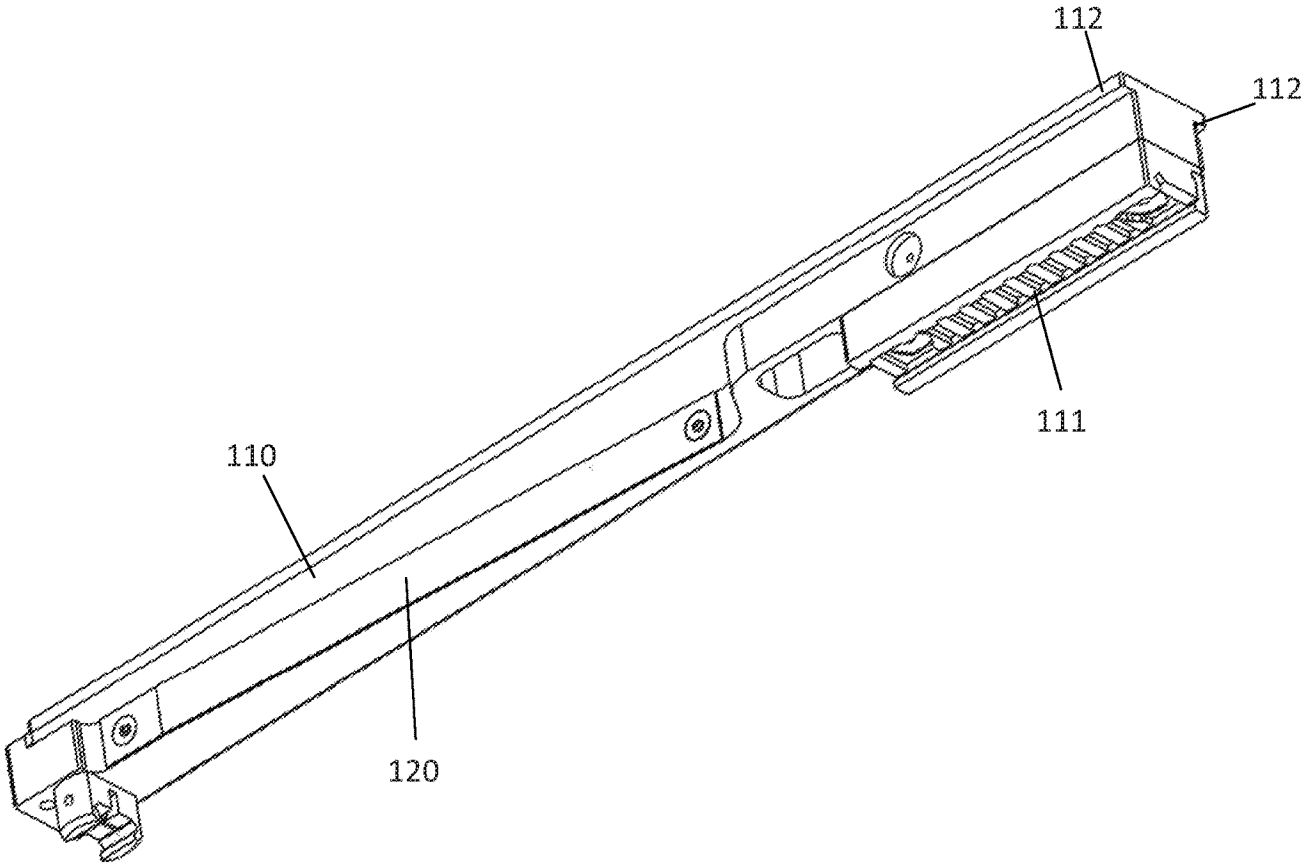
FIG. 2 is a perspective representation of the motion guide and ramp.

The motion guide 110 and ramp 120 are shown in FIG. 2. The motion guide 110 is adapted to fixedly mount to a platform, such as a robot or an aerial drone via a mounting surface 111. The preferred mounting surface incorporates common accessory mount design such as a STANAG 2324 or MIL-STD 1913 Picatinny rail, however custom mounting surfaces may be used to accommodate the platform structure. The motion guide also has parallel ridges 112 on opposite faces of the longest dimension. These ridges provide a guide surface and interlock mount structure for the recoil chassis. The parallel ridges 112 of the motion guide constrain the motion of the recoil chassis to a linear translation along the motion guide.

Figure 9:
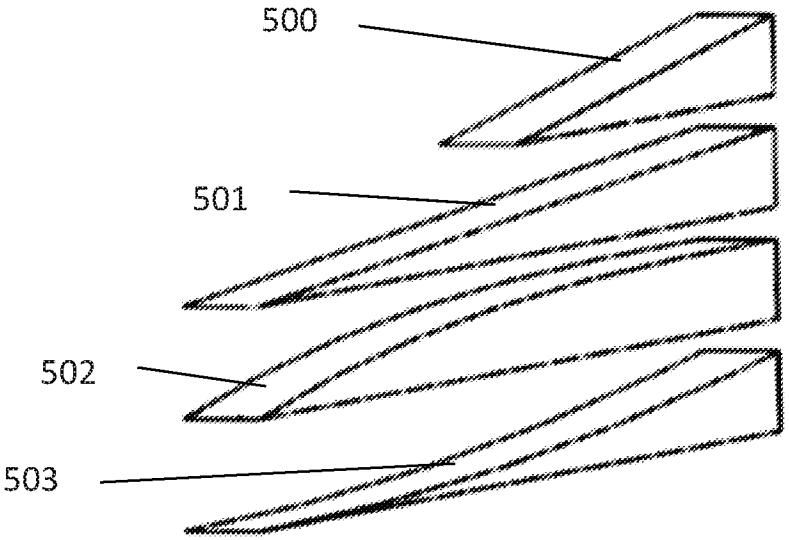
FIG. 9 is a perspective representation of the contact surface modifications of the ramp.

The ramp 120 mounts rigidly to the motion guide. In the preferred embodiment, the ramp surface in contact with the transfer mechanism is tailored to linearize the force of the recoil by modifying the recoil stroke imparted by the recoiling mass of the apparatus to match the ideal stroke of the selected dissipator. Force profiles other than a linear profile can also be achieved through use of alternative ramp surface profiles. FIG. 9 shows several modifications of ramp contact surfaces including shaped planar 500 and 501, convex 502, and concave 503 contact surfaces. A combination forming multi-segmented contact surfaces could also be used. The ramp mass and the motion guide mass do not contribute to the recoiling mass of the apparatus, and therefore should be constructed of lightweight yet strong materials to maximize overall mass efficiency.

Figure 3:
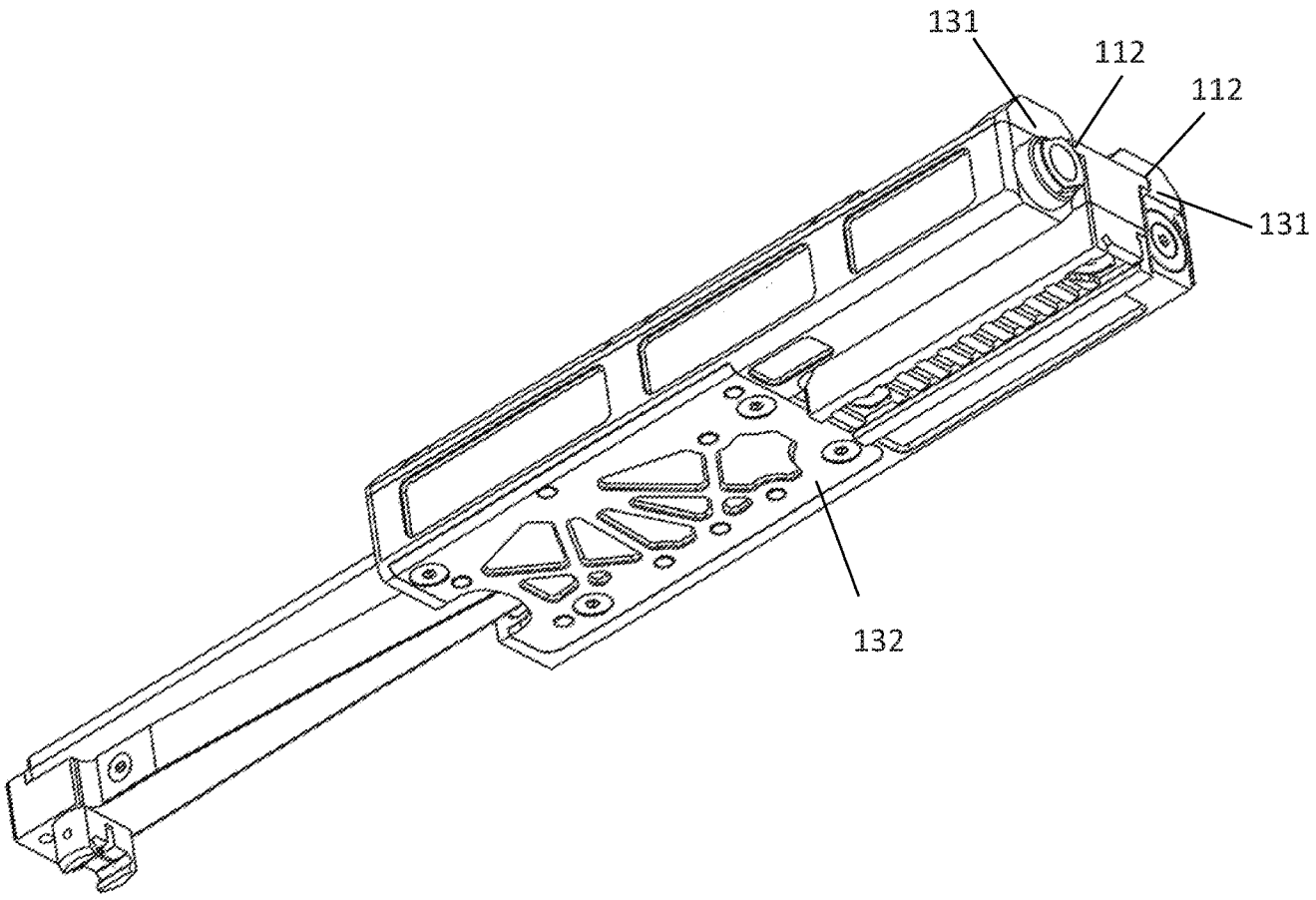
FIG. 3 is a perspective representation of the recoil apparatus with recoil chassis housing.

The recoil apparatus with recoil chassis housing 132 is shown in FIG. 3. The recoil chassis 130 moveably mounts to the motion guide with complimentary faces 131 interlocking the parallel ridges 112 on the motion guide. The parallel ridges serve to limit the motion of the recoil chassis to a linear translation stroke along the motion guide during recoil.

Figure 4A:
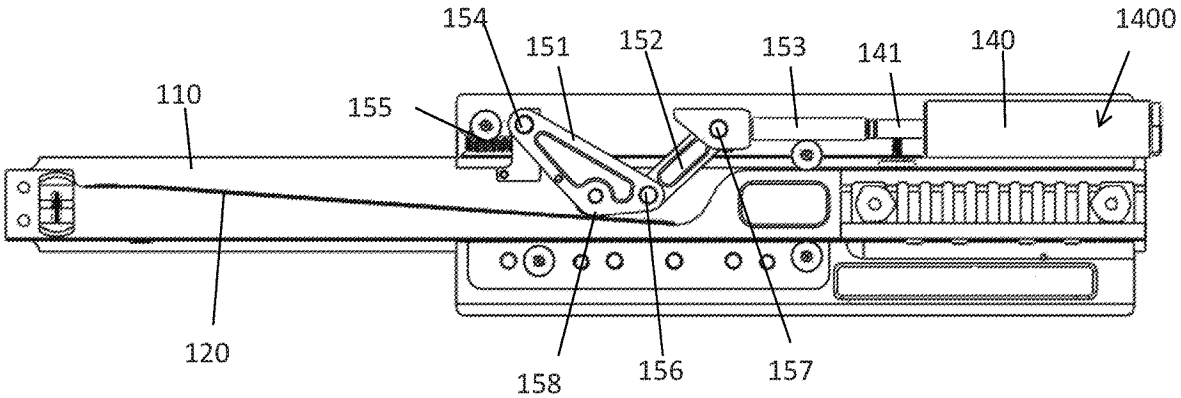
FIG. 4A is a bottom view of the ramp, transfer mechanism and dissipator in a pre-fire position.
Figure 4B:
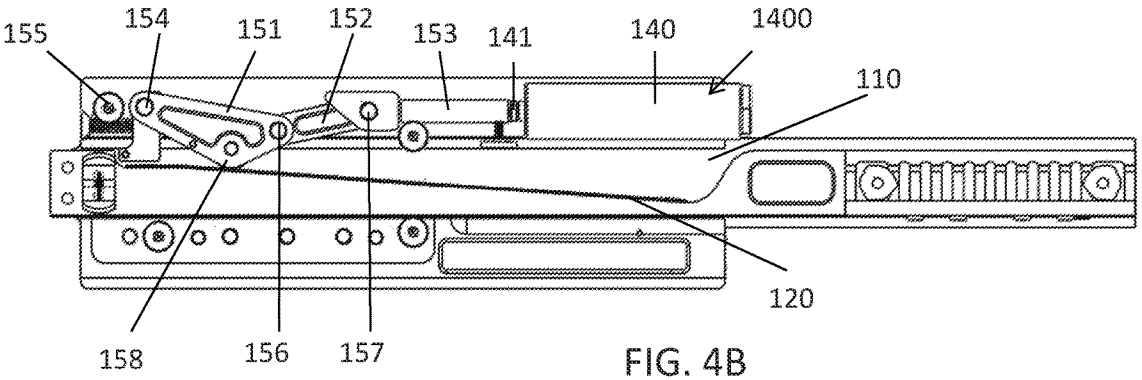
FIG. 4B is a bottom view of the ramp, transfer mechanism and dissipator in a post-dissipation position.

The dissipator and transfer mechanism fixedly mount to the recoil chassis. The transfer mechanism matches the physical stroke of the sliding recoil chassis to the physical stroke of the dissipator. FIG. 4A shows one embodiment with the ramp mounted to the motion guide, and the transfer mechanism and dissipator mounted to the recoil chassis in a compressed pre-fire position. FIG. 4B shows the same embodiment in a post-dissipation position.

In the embodiment of FIG. 4A, the transfer mechanism is a mechanical linkage composed of a base link 155, a roller-tipped link 151, a two-point link 152, and a sliding piston 153 joined by three pivot joints. The base link 155 is mechanically fixed to or integrally formed with the recoil chassis. The roller-tipped link 151 has a pivot joint 154 coupling to the base link 155, a roller tip 158 in contact with the ramp 120 structure surface, and a second pivot joint 156 coupling to the two-point link 152. The two-point link has an additional pivot joint 157 coupling to the sliding piston 153. The sliding piston has four flat bearing surfaces which slide along complementary flat bearing surfaces on the recoil chassis, constraining the motion of the sliding piston to a translation that is parallel to the axis of the dissipator 140. Alternate transfer mechanism linkages may be used to convert the longer recoil stroke of the recoil chassis into a shorter stroke acting upon the dissipator.

The dissipator converts kinetic energy to waste heat in a well-defined manner over a physical stroke. In the embodiment of FIG. 4A, the dissipator 140 is a hydraulic dissipator. The shaft 141 of the hydraulic dissipator is shown protruding from the hydraulic dissipator body and connected to the sliding piston of the transfer mechanism. The dissipator is detachably mounted to the recoil chassis for replacement or kinetic energy modification using additional commercially-available dissipator components. The preferred embodiment uses a variable-orifice hydraulic dissipator. The variable-orifice hydraulic dissipator is designed to maintain a substantially constant reaction force throughout the recoil stroke. The length of the motion guide and size of the dissipator can vary to accommodate a wide range of recoil kinetic energy and transferred force according to the recoiling mass allowance and the level of force that the platform can tolerate. A variety of suitable dissipators are commercially-available. Other dissipators could alternatively be used including dry friction dissipators, pneumatic dissipators, magnetorheological dissipators, and electromagnetic dissipators.

When the recoil chassis is in a forward position along the motion guide 110, as shown in FIG. 4A, the roller-tipped link 151 is in contact with a forward portion of the ramp surface 120, which places the transfer mechanism linkage in a compressed geometry.

As the recoil chassis travels rearward along the motion guide rail, as shown in FIG. 4B, the roller tip 158 maintains contact with the ramp surface 120. The ramp surface forces the roller-tipped link 151 to pivot with respect to the base link 155, and acting through the two-point link 152, causes the sliding piston 154 to slide forward with respect to the dissipator 140, compressing the hydraulic dissipator shaft 141 into the dissipator 140. In embodiments utilizing a hydraulic dissapator, the compression causes hydraulic fluid to travel through one or more constrictive orifices or pathways, converting kinetic energy of the recoil chassis into thermal energy in the hydraulic fluid.

In embodiments utilizing a dry friction dissipator, the compression of the sliding piston causes dry friction surfaces to rub, converting kinetic energy of the recoil chassis into thermal energy in the friction surface materials. In embodiments utilizing a pneumatic dissipator, the compression of the sliding piston causes a compressible fluid such as a gas to travel through a throttling orifice, converting kinetic energy of the recoil chassis into thermal energy in the gas. In embodiments utilizing a magnetorheological dissipator, the compression of the sliding piston causes a magnetorheological fluid to travel through an orifice, converting kinetic energy of the recoil chassis into thermal energy in the magnetorheological fluid. Additional active control of the dissipation characteristics can be achieved by subjecting the magnetorheological fluid to an electromagnetic field to alter the apparent viscosity of the fluid, and therefore alter its flow through the orifice. In embodiments utilizing an electromagnetic dissipator, the compression of the sliding piston causes a magnet to move relative to a conductive coil, converting kinetic energy of the recoil chassis into electrical energy in the coil. These alternative embodiments of the dissipator 140 are represented by a box labelled 1400 on FIG. 4A.

The preferred recoil mitigation embodiment for use with a multi-shot disrupter mounted on a robotic platform utilizes a mass-efficient design. A disrupter system is necessarily limited in the total mass allowable, whether to remain easily portable or to remain within the limits of a robot platform or robot armature load-bearing capacity. This total allowable mass limit may be divided conceptually into a recoiling mass portion and a fixed mass portion. The mass-efficient design reduces the initial amount of kinetic energy input into the firing disrupter by apportioning a maximized fraction of the allowed total mass into the recoiling mass and a minimized fraction into the fixed mass portion. The recoiling mass undergoes direct acceleration during fire, while the fixed portion is not accelerated directly during fire. Due to the conservation of momentum, the product of the disrupter mass and disrupter velocity of free recoil will be equal to the projectile momentum. Projectile momentum is the product of the projectile mass and projectile velocity, including gaseous components from the propellant. The disrupter kinetic energy of free recoil will then be equal to one half times the disrupter mass times the velocity of free recoil squared. Because of the linear relationship between kinetic energy and mass, and the squared relationship between kinetic energy and velocity, it is observed that a reduction in recoil kinetic energy is achieved by increasing the recoiling mass, if the recoil momentum is held constant.

Figure 5:
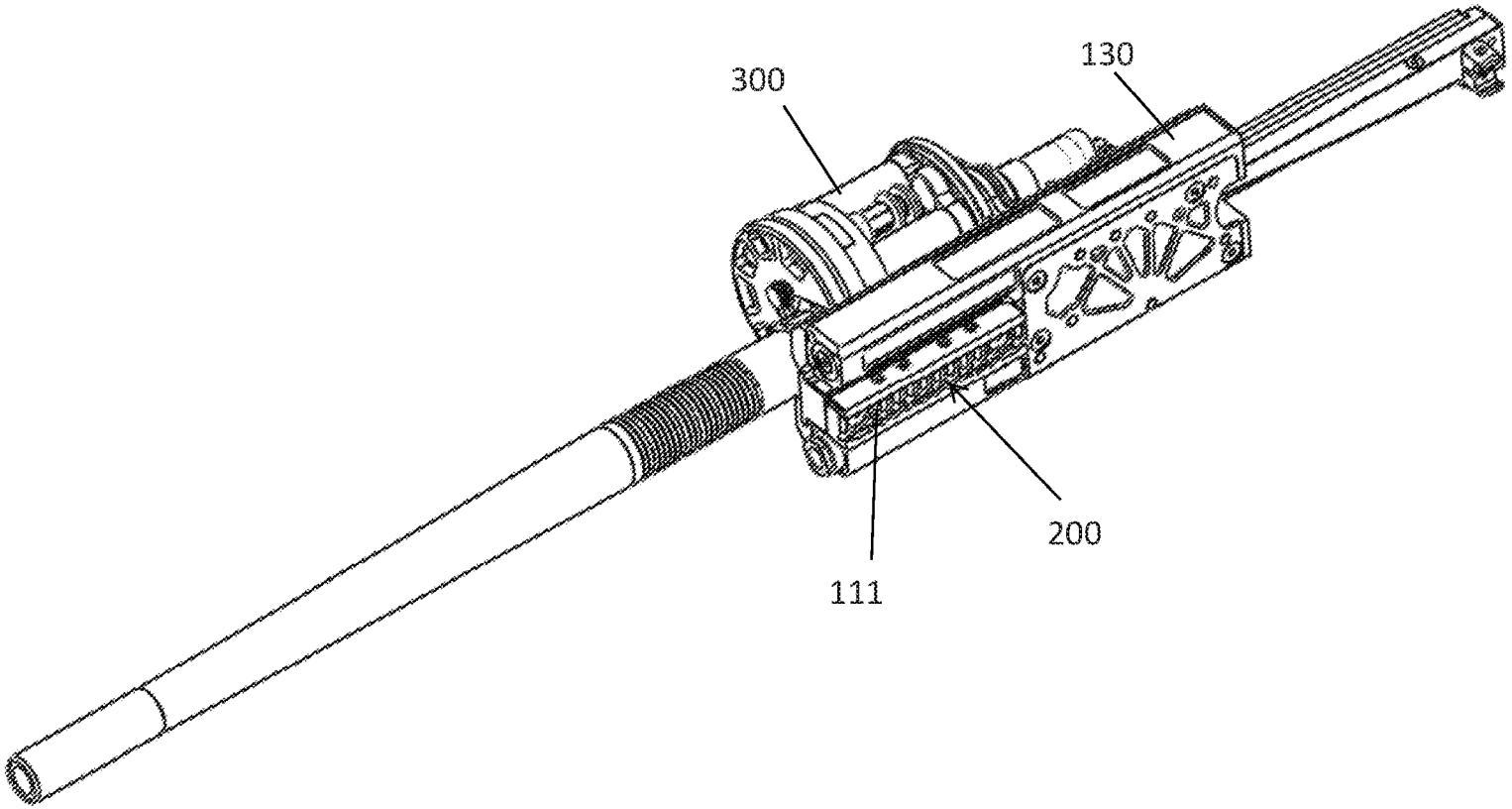
FIG. 5 is a perspective representation of the recoil apparatus mounted to a multi-shot disrupter showing robotic platform mounting positions.

FIG. 5 is a perspective representation of the recoil apparatus mounted to a multi-shot disrupter 300 showing the preferred platform mounting surface 111. The preferred robotic platform is represented in FIG. 5 by a box labelled 200. The recoil chassis, dissipator, transfer mechanism and a mounted multi-shot disrupter form the recoiling mass of the apparatus. The motion guide is fixedly attached to the robotic platform at the platform mounting surface 111 and the ramp is fixedly mounted to the motion guide. The motion guide and ramp are not included in the recoiling mass of the apparatus. The preferred mass-efficient apportionment embodiment minimizes the mass of the motion guide by limiting the length of the motion guide to the anticipated recoil chassis travel required for dissipation of a maximum disrupter load using the maximum allowable transferred force. Mass of the motion guide and ramp are minimized through choice of strong lightweight materials such as aluminum and fiber-filled composites, with limited use of heavier materials such as steel or titanium for surfaces which must be hard, such as the contact surface of the ramp. The mass of the ramp is also minimized by reducing the height of the ramp necessary to actuate the full stroke length of the dissipator and by limiting the ramp length to the anticipated transfer mechanism travel required for a maximum disrupter load recoil dissipation. The multi-shot disrupter 300 is mounted to the recoil chassis 130 so the mass of the disrupter is included in the recoiling mass.

Figure 6:
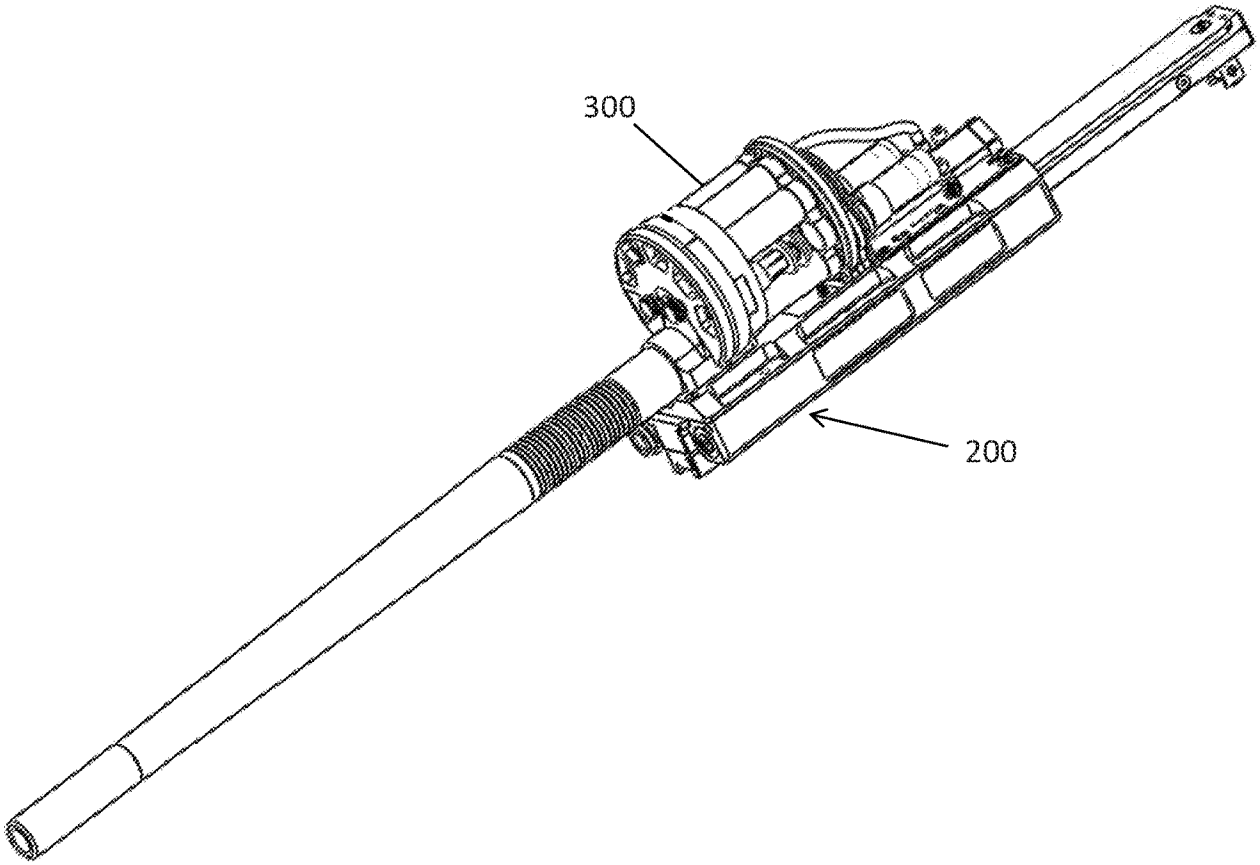
FIG. 6 is a perspective representation of the recoil apparatus with mounted multi-shot disrupter.
Figure 7:
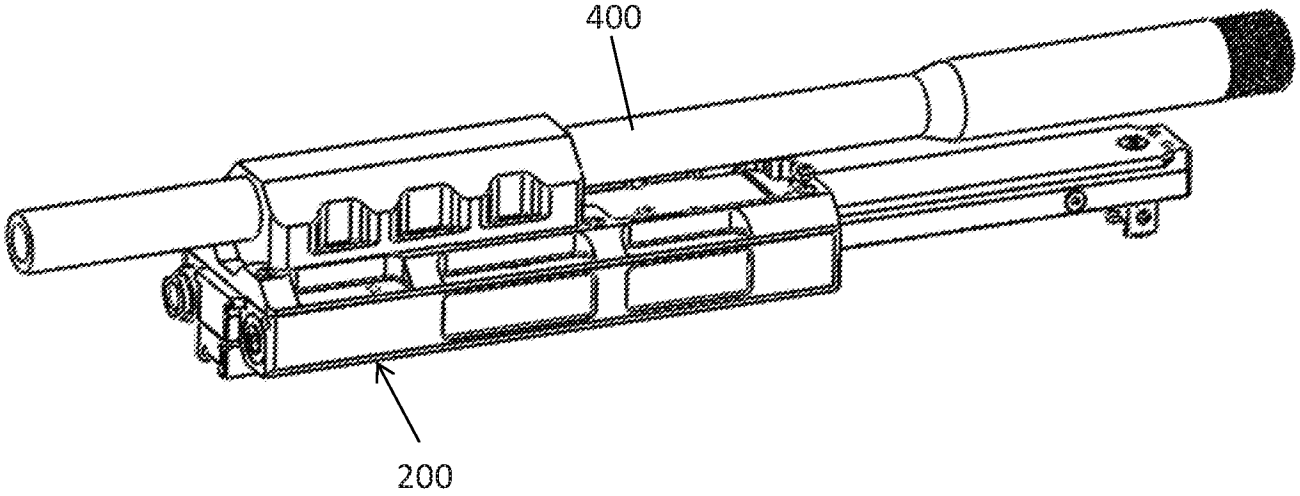
FIG. 7 is a perspective representation of the recoil apparatus with mounted single-shot disrupter.

The recoil chassis-mounted multi-shot disrupter embodiment allows implementation of disrupter design changes without affecting the overall recoil profile so long as the original multi-shot disrupter mass is maintained. Further, the recoil apparatus design offers recoil mitigation over a wide variety of projectile-firing device and platform combinations. FIG. 6 shows another perspective representation of the recoil apparatus with mounted multi-shot disrupter 300 and with a platform represented in FIG. 6 by a box labelled 200. FIG. 7 shows the recoil apparatus with mounted single-shot disrupter 400, with a platform represented in FIG. 6 by a box labelled 200.

Figure 8:
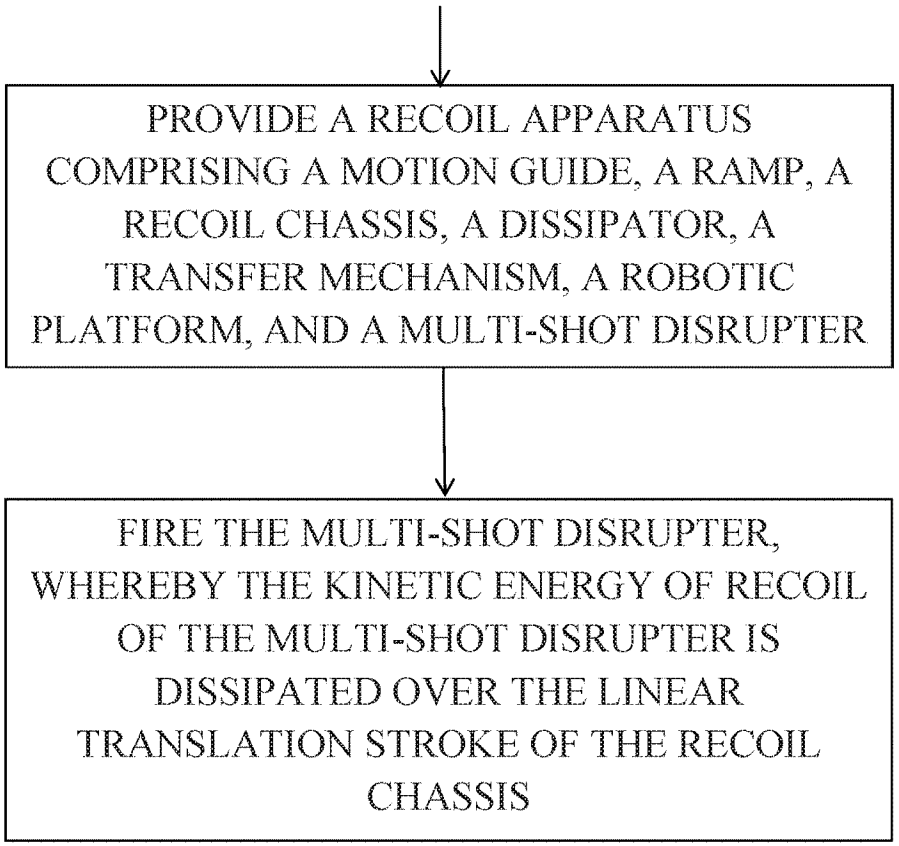
FIG. 8 illustrates an example method according to the embodiments of the invention.

The method of the present invention relates to dissipation of recoil energy caused by firing a multi-shot disrupter using the recoil apparatus. The method of mitigating recoil, illustrated in FIG. 8, comprises the steps of providing a recoil apparatus of the present invention with a robotic platform, a motion guide, a ramp, a recoil chassis, a transfer mechanism, a dissipator, and a multi-shot disrupter; and firing the multi-shot disrupter, whereby the kinetic energy of recoil of the multi-shot disrupter is dissipated over the linear translation stroke of the recoil chassis. The method provides a mass-efficient technique to mitigate recoil energy from a multi-shot disrupter mounted on a robotic platform.

The method allows an operator to fire a multi-shot disrupter from a robotic platform by mitigating the recoil caused during firing in a mass-efficient manner. The positioning of the disrupter, dissipator, and transfer mechanism on the recoil chassis maximizes the recoiling mass of the system without modifying the total mass or design of the robotic platform. The recoil chassis configuration improves the ability of the dissipator to convert kinetic energy to heat by spreading the deceleration of the recoiling mass over the length of the motion guide while linearizing the shorter dissipator stroke using the ramp and transfer mechanism. The recoil mitigation method and apparatus disclosed are particularly suited to improve recoil over prior art robotic platform mounted disrupter embodiments.

Having described the invention in detail with reference to the accompanying drawings in which examples of embodiments of the invention are shown, it is to be understood the forgoing embodiments are not intended to limit the form of the invention. It should also be noted that these embodiments are not mutually exclusive. Thus, components or features from one embodiment may be assumed to be present or used in another embodiment, where such inclusion is suitable.

What is claimed is:

1. A recoil apparatus comprising:

a motion guide adapted to fixedly mount to a platform and having parallel ridges on opposite faces of the longest dimension;

a ramp fixedly mounted to the motion guide;

a recoil chassis adapted to fixedly mount to a projectile-firing device and moveably mounted to the motion guide with faces interlocking the parallel ridges on the motion guide, wherein the motion of the recoil chassis is limited to a linear translation stroke along the motion guide;

a dissipator adapted to convert kinetic energy into waste heat over a dissipator stroke, wherein the dissipator is detachably mounted to the recoil chassis; and a transfer mechanism mounted to the recoil chassis, in communication with the ramp, and in communication with the dissipator, wherein the transfer mechanism is adapted to match the linear translation stroke of the recoil chassis to the dissipator stroke.

2. The recoil apparatus of claim 1, wherein the dissipator is selected from a group consisting of: a hydraulic dissipator, a dry friction dissipator, a pneumatic dissipator, a magnetorheological dissipator, and an electromagnetic dissipator.

3. The recoil apparatus of claim 1, wherein the transfer mechanism is a sliding piston, a two-point link, a roller-tipped link, and a base link.

4. The recoil apparatus of claim 1, further comprising:

a platform fixedly mounted to the motion guide; and a projectile-firing device fixedly mounted to the recoil chassis.

5. The apparatus of claim 4, wherein the projectile-firing device is a multi-shot disrupter, and wherein the platform is a robotic platform.

6. A method of mitigating recoil comprising, in combination:

providing a recoil apparatus that comprises a motion guide adapted to fixedly mount to a robotic platform and having parallel ridges on opposite faces of the longest dimension, a ramp fixedly mounted to the motion guide, a recoil chassis adapted to fixedly mount to a multi-shot disrupter and moveably mounted to the motion guide with faces interlocking the parallel ridges on the motion guide, wherein the motion of the recoil chassis is limited to a linear translation stroke along the motion guide, a dissipator adapted to convert kinetic energy into waste heat over a dissipator stroke, wherein the dissipator is detachably mounted to the recoil chassis, a transfer mechanism mounted to the recoil chassis, in communication with the ramp, and in communication with the dissipator, wherein the transfer mechanism is adapted to match the linear translation stroke of the recoil chassis to the dissipator stroke, a robotic platform fixedly mounted to the motion guide, and a multi-shot disrupter fixedly mounted to the recoil chassis; and firing the multi-shot disrupter, whereby the kinetic energy of recoil of the multi-shot disrupter is dissipated over the linear translation stroke of the recoil chassis.

* * * * *